US009172191B2

(12) United States Patent
Reul et al.

(10) Patent No.: US 9,172,191 B2
(45) Date of Patent: Oct. 27, 2015

(54) HOUSING FOR ELECTRICAL CONNECTION BETWEEN A FOIL CONDUCTOR AND A CONDUCTOR

(75) Inventors: Bernhard Reul, Herzogenrath (DE); Andreas Schlarb, Wuppertal (DE)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 103 days.

(21) Appl. No.: 13/813,417

(22) PCT Filed: Jul. 21, 2011

(86) PCT No.: PCT/EP2011/062504

§ 371 (c)(1),
(2), (4) Date: Apr. 22, 2013

(87) PCT Pub. No.: WO2012/019893

PCT Pub. Date: Feb. 16, 2012

(65) Prior Publication Data

US 2013/0224990 A1 Aug. 29, 2013

(30) Foreign Application Priority Data

Aug. 9, 2010 (EP) ..... 10172257

(51) Int. Cl.

| | |
|---|---|
| ***H01R 12/70*** | (2011.01) |
| ***H01R 13/56*** | (2006.01) |
| ***H01R 43/20*** | (2006.01) |
| ***H01R 12/63*** | (2011.01) |
| *H01R 13/58* | (2006.01) |

(52) U.S. Cl.

CPC ..... *H01R 23/66* (2013.01); *H01R 12/63* (2013.01); *H01R 13/56* (2013.01); *H01R 43/20* (2013.01); *H01R 13/5845* (2013.01); *Y10T 29/49208* (2013.01)

(58) Field of Classification Search

USPC ..... 439/62, 67, 493, 495

See application file for complete search history.

(56) References Cited

U.S. PATENT DOCUMENTS

| | | | | |
|---|---|---|---|---|
| 3,737,833 | A | 6/1973 | Jerominek | |
| 3,825,878 | A * | 7/1974 | Finger et al. | 439/493 |
| 4,744,764 | A * | 5/1988 | Rubenstein | 439/62 |
| 4,798,541 | A * | 1/1989 | Porter | 439/67 |
| 4,815,979 | A * | 3/1989 | Porter | 439/62 |
| 4,832,609 | A * | 5/1989 | Chung | 439/67 |
| 4,900,269 | A * | 2/1990 | Lynch | 439/499 |

(Continued)

FOREIGN PATENT DOCUMENTS

| | | |
|---|---|---|
| DE | 93 13 394 | 12/1993 |
| DE | 42 35 063 | 4/1994 |

(Continued)

OTHER PUBLICATIONS

PCT Written Opinion for PCT/EP2011/062504 filed on Jul. 21, 2011 in the name of Saint-Gobain Glass France (with English translation).

(Continued)

*Primary Examiner* — Alexander Gilman
(74) *Attorney, Agent, or Firm* — Steinfl & Bruno LLP

(57) ABSTRACT

A housing having an electrical connection between a conductor and a foil conductor is described. An inlet opening (8) of the housing is rounded off at entry edges thereof on at least one side for the foil conductor, such that the inlet opening increasingly expands in an outward direction.

18 Claims, 6 Drawing Sheets

(56) References Cited

U.S. PATENT DOCUMENTS

Figure 1A:
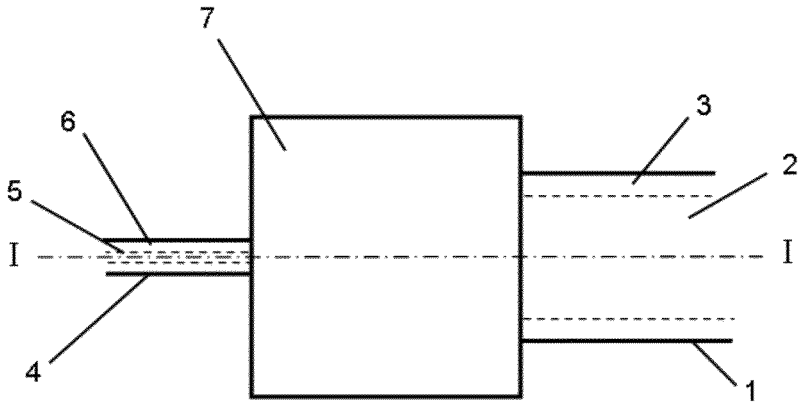

| | | | | |
|---|---|---|---|---|
| 5,724,730 | A | 3/1998 | Tanaka | |
| 6,077,124 | A * | 6/2000 | Etters et al. | 439/632 |
| 7,520,416 | B2 * | 4/2009 | Crumbach et al. | 228/121 |
| 2005/0009382 | A1 * | 1/2005 | Burmeister et al. | 439/67 |
| 2013/0224990 | A1 * | 8/2013 | Reul et al. | 439/495 |

FOREIGN PATENT DOCUMENTS

| | | |
|---|---|---|
| DE | 199 44 493 | 3/2001 |
| DE | 199 60 450 | 5/2001 |
| DE | 100 06 122 | 8/2001 |
| DE | 100 65 354 | 7/2002 |
| DE | 103 53 807 | 6/2005 |
| DE | 20 2004 019 286 | 5/2006 |
| EP | 0 593 940 | 4/1994 |
| EP | 1 058 349 | 12/2000 |
| EP | 1 437 799 | 7/2004 |
| JP | 10-116659 | 5/1998 |
| WO | WO 89/02172 | 3/1989 |

OTHER PUBLICATIONS

PCT International Search Report for PCT/EP2011/062504 filed on Jul. 21, 2011 in the name of Saint-Gobain Glass France (with English translation).

* cited by examiner

HOUSING FOR ELECTRICAL CONNECTION BETWEEN A FOIL CONDUCTOR AND A CONDUCTOR

CROSS REFERENCE TO RELATED APPLICATIONS

The present application is the US national stage of International Application PCT/EP2011/062504 filed on Jul. 21, 2011 which, in turn, claims priority to European Patent Application EP 10172257.7 filed on Aug. 9, 2010.

The invention relates to a housing for electrical connection between a foil conductor and a conductor, as well as a method for production thereof.

Flexible foil conductors, sometimes also called "flat conductors" or "flat-band conductors", are frequently used in motor vehicle construction, in particular to enable flexible, electrical contacting under limited space conditions.

Foil conductors are customarily made of a tinned copper strip with a thickness of 0.03 mm to 0.1 mm and a width of 2 mm to 16 mm. Copper has proved successful for such conductor tracks, since it has good electrical conductivity as well as good processability into foils, and, at the same time, material costs are low. Other electrically conductive materials that can be processed into foils can also be used. Examples for this are gold, silver, aluminum, or tin.

For electrical insulation and for stabilization, the tinned copper strip is applied to a carrier material made of plastic or laminated therewith on both sides. The insulation material is made, as a rule, from a 0.025 mm to 0.05 mm thick polyimide-based film. However, other plastics or materials with the required insulating properties can also be used. A plurality of conductive layers electrically isolated from each other can be situated in one foil conductor strip.

In the motor vehicle sector, foil conductors are customarily used for contacting electrically functional layers in composite glass panes. Examples are found in DE 42 35 063 A1, DE 20 2004 019 286 U1, or DE 93 13 394 U1.

Such composite glass panes are usually made of at least two rigid individual glass panes that are adhesively bonded to each other area-wise by a thermoplastic adhesive layer. The thickness of the adhesive layer is, for example, 0.76 mm. Additionally, electrically functional layers, such as heating coatings and/or antenna elements, that are connected to a foil conductor are situated between the individual glass panes. A foil conductor suitable for this has a total thickness of only 0.3 mm. Such thin foil conductors can be embedded without difficulty in the thermoplastic adhesive layer between the individual glass panes.

The use of foil conductors for contacting electrically functional layers is not limited to the motor vehicle sector alone. As is known from DE199 60 450 C1, foil conductors are also used in the construction sector. In composite glass panes or insulating glass panes, foil conductors serve for electrical contacting of integrated electrical components such as voltage-controlled electrochromic layers, solar cells, heating wires, alarm loops, or the like.

Usually, a pane with a complete connection element and plug for toolless connection to another electrical control system is required from the pane manufacturer. Here, the connection element comprises a roughly 5 cm to 20 cm long foil conductor and at least one round cable with a plug connector. The connection between the foil conductor and the cable is usually made by soft soldering and is protected by a housing.

Due to the small thicknesses of metal foil and of insulation foils, foil conductors have only slight protection against tearing and even less resistance to tear propagation. In particular, if the foil conductor has to be guided over corners or sharp edges, tensile forces can be concentrated in small areas and can locally exceed the tear resistance of the foil conductor or one of its layers.

Such tensile loads on the foil conductor occur, in particular, during transport as well as during assembly of the pane. A defect in the electrical contacting of the foil conductor customarily results in discarding the entire pane.

Fixing the transition between the foil conductor and the cable as near as possible or on the pane, as described in EP 593 940 A1, provides a remedy. However, in many installation situations, it is desirable to guide the foil conductor around a frame structure or mounting flange without optically and aesthetically disruptive elements such as plugs or components being situated on the pane.

In the field of housings of electrical connectors to accommodate foil conductors, extensive prior art is known.

U.S. Pat. No. 5,724,730 and EP 1 058 349 A1 disclose electrical connectors between foil conductors and round cables by means of soldered connections. In each case, the housing around the connection point is designed in two parts. The entry opening of the housing for the foil conductor has right-angled sharp entry edges on both sides.

DE 199 44 493 A1, DE 100 06 112 A1, and DE 100 65 354 A1 describe, in each case, a connection element for mechanical fixing and for electrical contacting of foil conductors. The entry opening of the foil conductor into the housing is designed funnel-shaped, with a bevel in each case per entry edge.

In practice, damages to a foil conductor occur, in particular, at the point of entry into a housing. These happen when the foil conductor is subjected to a tensile load via a sharp edge or the foil conductor is twisted. In the region of the edge, such an impingement of force can result in an at least partial cutting through of its electrically conductive layer or even to destruction of the complete foil conductor.

The object of the present invention consists in providing a housing for electrical connection of a foil conductor to a conductor that minimizes damage to the foil conductor at the entry opening in the event of tensile loading.

The object of the present invention is accomplished according to the invention by a housing for electrical connection of a foil conductor to a conductor according to claim 1. Preferred embodiments emerge from the subclaims.

A use of the housing according to the invention and a method for production thereof emerge from further claims.

The present invention comprises a housing with an electrical connection between a conductor and a foil conductor. The entry opening of the housing for the foil conductor is rounded on its entry edges at least on one side such that the entry opening is increasingly expanded outward. The rounded region of the entry edge preferably runs parallel to the wide side of the foil conductor. In other words, the entry edge runs parallel to the wide side of the foil conductor and the edge itself is rounded. Preferably, both the upper entry edge and the lower entry edge are rounded.

An embodiment of the housing with only one rounded entry edge is advantageous when the housing is connected, for example, to a substrate. In that case, a foil conductor undergoes no tensile loading in the direction toward the substrate. The rounded edge is then advantageously the entry edge turned away from the substrate. The entry edge facing the substrate, which edge is disposed between the foil conductor and the substrate, does not have to be rounded since, because of the substrate, the foil conductor cannot be stressed by this entry edge.

The rounded region of the entry edge extends preferably over an angular segment with an angle of 30° to 180°, preferably 80° to 180°, particularly preferably 135° to 180°. The larger the rounded region of the entry edge, the farther the foil conductor can be curved out of its straight extgension direction without running over a sharp edge. The rounded region of the entry edge begins preferably at the point at which the foil conductor exits the housing and is no longer fixedly connected to the housing.

As used herein, the term "rounding" means a round shape without edges or corners, in other words, without points having a very small radius of curvature. The rounded region of the entry edge of the housing according to the invention has, preferably, a radius of curvature of at least 0.5 mm. Particularly preferably, the radii of curvature are between 0.5 mm and 100 mm, in particular, between 0.5 mm and 20 mm. The minimum radius of curvature over which the foil conductor is deflected is decisive for the maximum tensile stress in the foil conductor. With a minimum radius of curvature of 0.5 mm, it is ensured that the foil conductor will not be damaged by the loads commonly occurring in the production process, during transport, during installation, or during use.

The rounded region of the entry edge is, preferably, oval, circular, or elliptical. In the case of a circular rounding, an angular segment of 180° corresponds to a semicircular entry edge and an angular segment of 90° corresponds to a rounding of the entry edge with the shape of a quarter circle.

The housing according to the invention is preferably produced from an electrically insulating material. Thermoplastic plastics and elastomers that are processed by injection molding methods are appropriate for industrial production. Such injection molding methods for producing plastic housings are adequately known, for example, from DE 103 53 807 A1. Used as thermoplastic plastics and elastomers are, for example, polyamide, polyoxymethylene, polybutylene terephthalate, or ethylene propylene diene rubber. Alternatively, hotmelt molding material such as acrylate or epoxy resin systems can be used.

If shielding of the electrical connection is necessary, the housing can be produced from an electrically conductive material with electrically insulating inserts.

The housing according to the invention is preferably produced as a single- or multi-part element and then equipped with the electrical connection along with the conductor and the foil conductor. Alternatively, the housing according to the invention can be cast directly around the electrical connection between the conductor and the foil conductor.

The electrical connection between the conductor and the foil conductor is preferably made by soldering, bonding, or welding. In the case of soldering, soft soldering with a low-melting solder is preferred. Alternatively, the electrically conductive connection can be made by gluing with an electrically conductive adhesive or clamping, for example, by means of a metallic clamp, sleeve, or plug connector.

The housing according to the invention serves preferably for electrical connection of a foil conductor with a conductor, for example, a round cable. Both foil conductors and conductors may be structured multi-wired and connected via multiple points. The housing according to the invention can serve for electrical connection of a plurality of foil conductors, preferably with each entry opening of the foil conductor into the housing having a rounded region. In another embodiment, an electrical connection between a foil conductor and a wire or a metallic contact element occurs, for example, to form a plug connection. Moreover, the electrical connection between a foil conductor and a conductor path, for example, of a printed circuit board with additional electronic components, can occur.

In another embodiment of the housing according to the invention, the rounded region of the entry edge consists of a separate element. The separate element can be made from the same material as the housing or a different material, preferably a softer material. A soft material can be better fitted to the foil conductor and distribute an impinging force over a greater area. This results in a reduction of the tensile stress. A circular packing cord or an O-ring made of rubber, perfluorinated rubber, polyethylene, or polytetrafluoroethylene can be used, for example, as a material for the separate element. The separate element is preferably inserted or clamped into the housing or adhesively bonded to the housing. The separate element preferably seals the interior of the housing, for example, against moisture.

In the event of twisting of the foil conductor relative to the housing or of an impingement of force in a direction oblique to its long direction or direction of extension, respectively, a foil conductor undergoes high peaks of tensile stress. This particularly involves the edges of the foil conductor, which must absorb a large part of the tensile stress. In another preferred embodiment of the invention, the entry edge has, in addition to the rounded region, a rounding in the direction of extension of the foil conductor. In the event of twisting or oblique loading, the foil conductor is guided along this rounding. The impinging force is distributed over a greater contact surface. The maximum tensile stress occurring in the foil conductor is reduced compared to the maximum tensile stress in a housing with a straight edge.

According to the invention, a new use of a housing in connection with the foil conductor was found for contacting electrically functional layers on or in single-pane safety glass panes or multipane composite glass panes. Such electrically functional layers are, for example, heating conductors and/or antenna conductors.

Preferably, the use according to the invention of the housing in connection with foil conductor connections occurs in the motor vehicle sector or in the construction sector.

The invention also includes a composite pane with a foil conductor for contacting electrically functional layers in its interior. Here, the foil conductor is electrically connected to another conductor in a housing according to the invention.

The object of the invention is further accomplished by a method for production of a housing with an electrical connection between a conductor and a foil conductor. Here, in a first step (a), the conductive layers of the foil conductor and the conductor are electrically conductively connected to one another. The electrically conductive connection occurs preferably by soldering, bonding, welding, or gluing with an electrically conductive adhesive. Alternatively, the electrically conductive connection can be made by long-lasting pressing together or clamping, for example, by means of a metallic clamp or sleeve.

In a second step (b), the connection between the foil conductor and the conductor is inserted into a first housing part. In a third step (c), a second housing part is mounted to fit on the first housing part and is connected thereto.

At least one of the housing parts, preferably both housing parts have a rounded region on the entry edges for the foil conductor. The connection of the two housing parts occurs through adhesive bonding, fusing, screwing, or clamping, for example, by means of locking mechanisms.

The two entry edges can be manufactured already during their production with an appropriately rounded shape. Alternatively, the rounding can occur in a separate step, for example, by means of milling, grinding, other ablation methods, or melting.

In one embodiment of the method according to the invention, the housing is, according to the first step (a), directly formed around the connection between the foil conductor and the conductor, for example, by injection molding. In that case, the mold predetermines the rounded shape of the entry edge on the foil conductor.

In the following, the invention is explained in detail with reference to several drawings. The drawings are purely schematic and not to scale. In particular, the layer thicknesses of foil conductors are depicted enlarged for visualization. The drawings in no way restrict the invention.

Figure 1B:
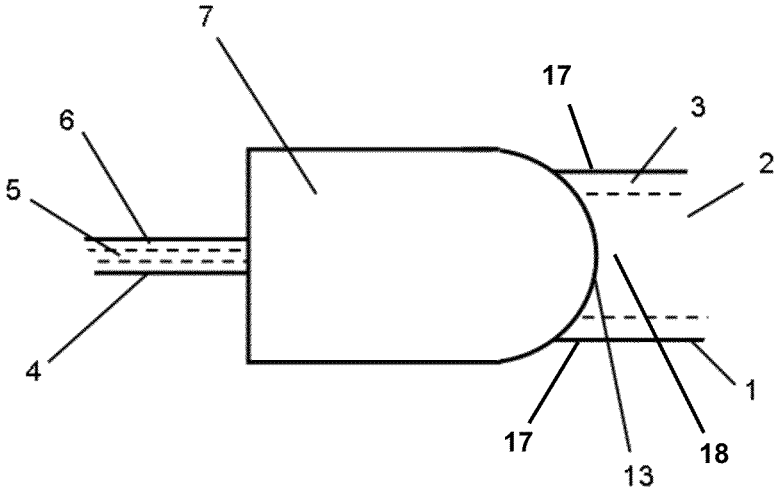
Figure 2:
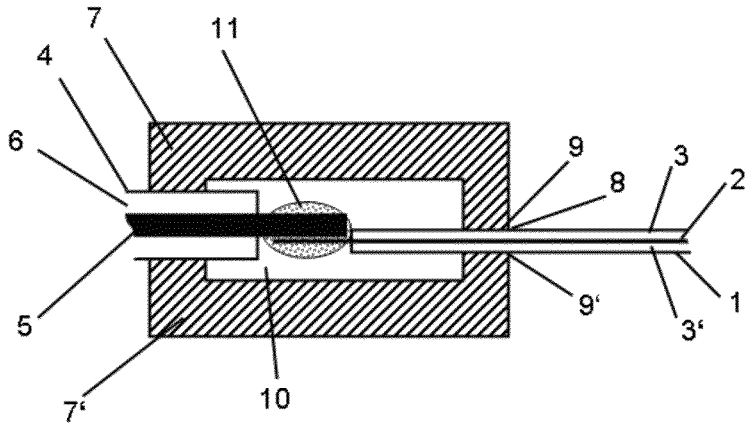
Prior Art FIG. 2
Figure 3:
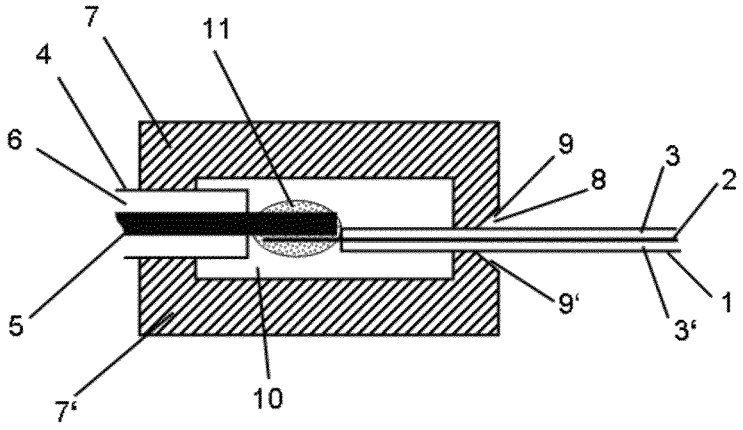
Prior Art FIG. 3
Figure 4:
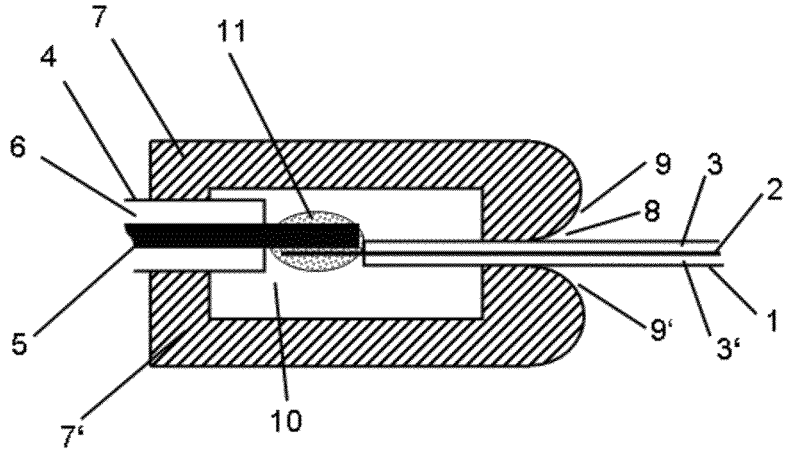
Figure 5:
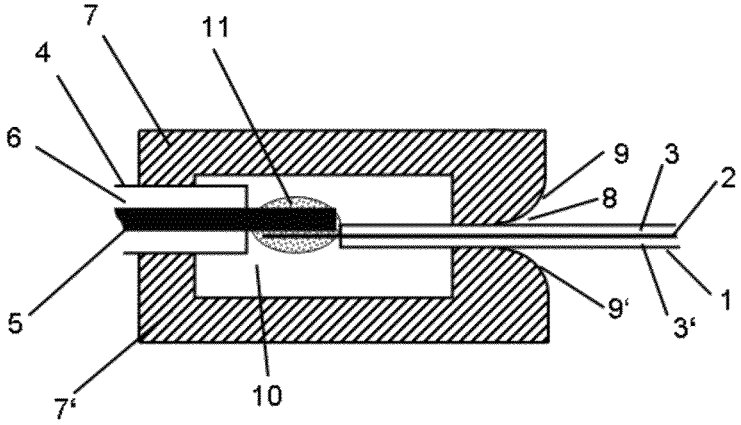
Figure 6:
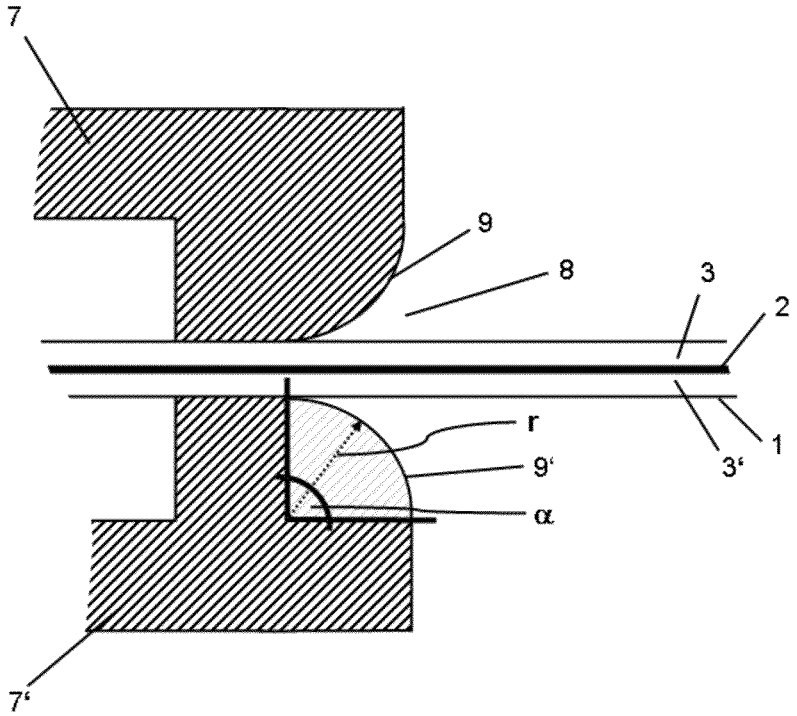
Figure 7:
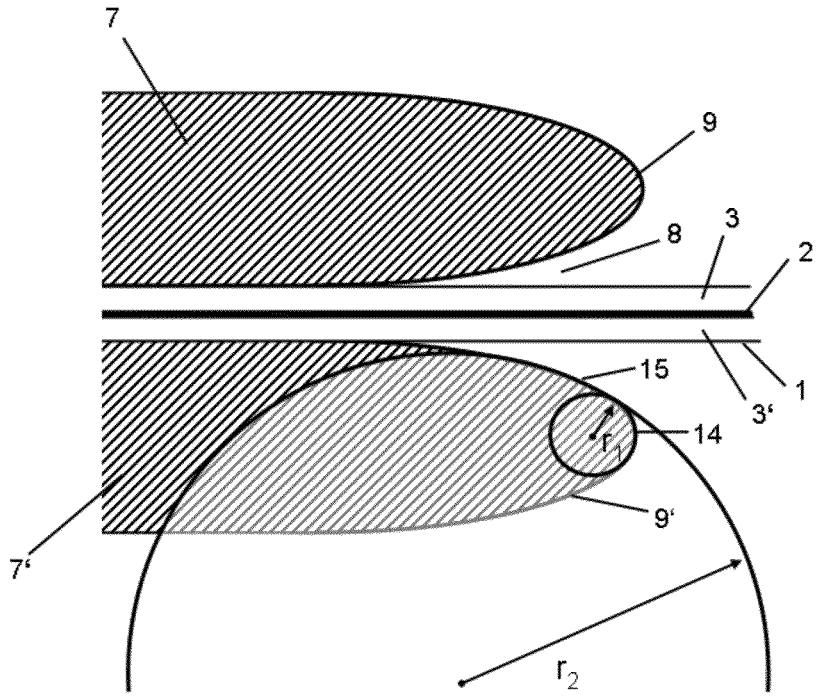
Figure 8:
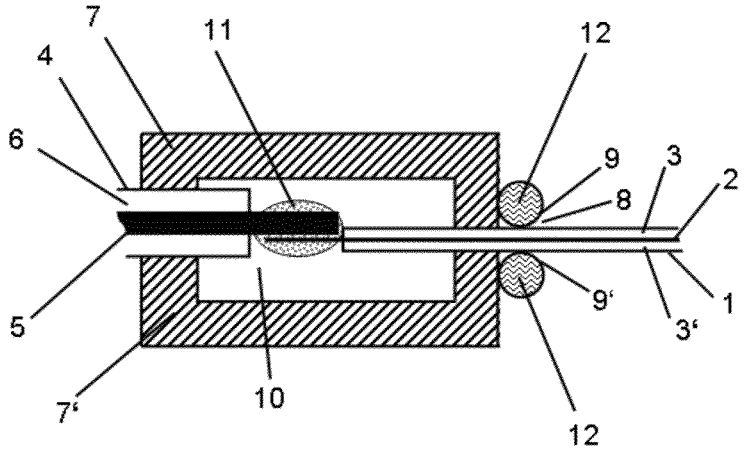
Figure 9:
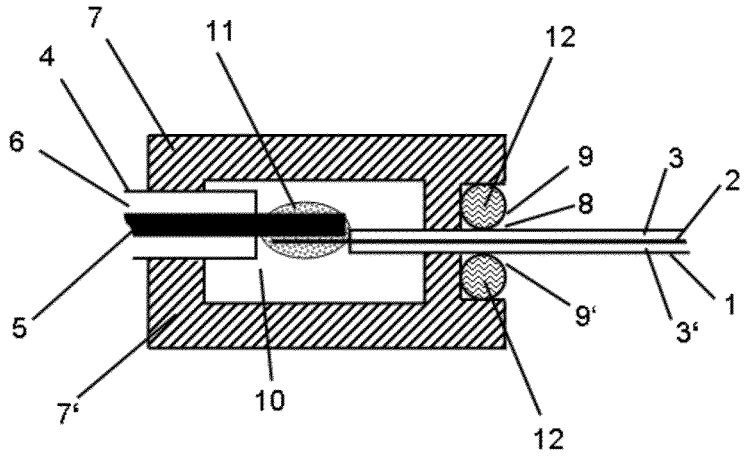
Figure 10:
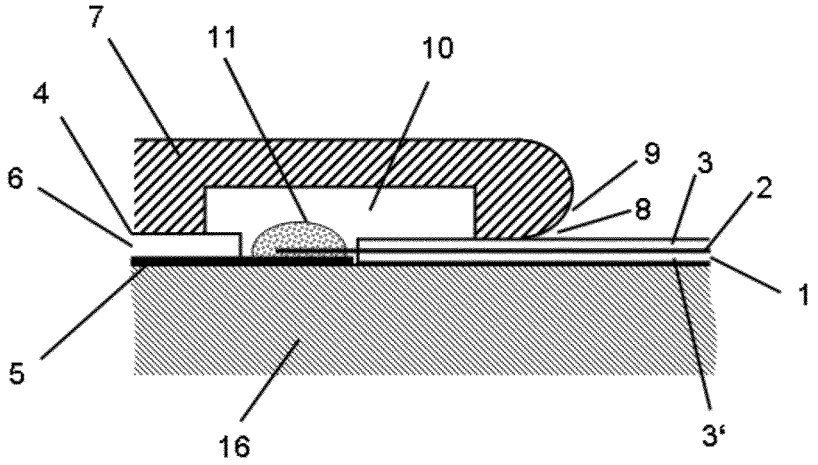

They depict:

FIG. 1A a housing with an electrical connection between a foil conductor and a conductor in plan view, FIG. 1B a housing according to the invention with an electrical connection between a foil conductor and a conductor as well as a rounding in the long direction of the foil conductor in plan view, FIG. 2 a longitudinal section along the line I-I of FIG. 1 through a housing with right-angled entry edges according to the prior art, FIG. 3 a longitudinal section along the line I-I of FIG. 1 through a housing with beveled entry edges according to the prior art, FIG. 4 a longitudinal section along the line I-I of FIG. 1 through an exemplary embodiment of a housing according to the invention with semicircular rounded entry edges, FIG. 5 a longitudinal section along the line I-I of FIG. 1 through another exemplary embodiment of a housing according to the invention with entry edges rounded in the shape of a quarter circle, FIG. 6 an enlarged detail of the region of the entry opening of FIG. 5, FIG. 7 an enlarged detail of the entry opening of a longitudinal section along the line I-I of FIG. 1 through a housing according to the invention with rounded entry edges, FIG. 8 a longitudinal section through another exemplary embodiment of a housing according to the invention with circular elements surface-mounted in the region of the entry edges, FIG. 9 a longitudinal section through another exemplary embodiment of a housing according to the invention with circular elements inserted into the housing in the region of the entry edges, and FIG. 10 a longitudinal section through another exemplary embodiment of a housing according to the invention for contacting a conductor on a substrate.

FIG. 1A is a schematic depiction of a housing (7) with an electrical connection between a foil conductor (1) and a conductor (4) in plan view. The electrically conductive layer (2) of the foil conductor (1) is concealed by the electrically insulating layer (3). The electrically conductive region (5) of the conductor (4) is concealed by an insulating region (6).

FIG. 1B is a schematic depiction of another embodiment variant of a housing (7) according to the invention. The housing (7) is rounded (13) in the direction of extension of the foil conductor (1). This rounding (13) occurs in combination with a rounding of the entry edges (9, 9') and ensures improved distribution of the tensile stress within the foil conductor (1) in the event of twisting or oblique loading of the foil conductor (1).

In the event of deflection or twisting of the foil conductor (1) relative to the housing (7) or an impingement of force in a direction oblique to its direction of extension, high peaks of tensile stress occur. This particularly involves the edges (17) of the foil conductor (1), which are particularly prone to cracking and damage. The particular advantage of this embodiment variant is the avoidance or reduction of tensile loads on the edges (17) of the foil conductor (1). Through the additional rounding (13) in the direction of extension of the foil conductor (1), the foil conductor (1) is guided, at the time of twisting or deflection, i.e., in the event of a tensile load, downward or upward relative to the direction of extension and thus into the plane of the drawing of FIG. 1B or out of the plane of the drawing of FIG. 1B, over the inner region (18) of the foil conductor (1). The forces occurring act on a flat area in the interior (18) of the foil conductor (1) and not point-wise on its edge (17). Through the combination of rounding (13) of the housing (7) in the direction of extension and rounding of the entry edges (9, 9'), an optimum distribution of force occurs in the foil conductor (1); and the maximum tensile stress in the foil conductor (1) is many times lower than with housings according to the prior art. The foil conductor (1) can withstand a much higher tensile load without being damaged than is the case with housings according to the prior art.

FIG. 2 depicts a longitudinal section along the line I-I of FIG. 1 of a housing (7, 7') with an electrical connection between a foil conductor (1) and a round cable (4) according to the prior art. The foil conductor (1) consists of an electrically conductive layer (2) made of tinned copper, which is laminated with two electrically insulating films (3, 3') made of plastic. The total thickness of the foil conductor (1) is roughly 0.3 mm. In the interior of the housing (7, 7'), the copper foil (2) stripped of insulation is soldered (11) to the electrically conductive region (5) of the round cable (4). The entry opening (8) of the housing (7, 7') for the foil conductor (1) is designed with right angles, with sharp edges (9, 9'). When, for example, tensile loading of the foil conductor (1) occurs orthogonal to its direction of extension, i.e., upward or downward in FIG. 2, the foil conductor is guided over the sharp entry edge (9 or 9'). High tensile stresses appear in the foil conductor in the region of the edge. If the local tensile stress exceeds the tear resistance of the foil conductor (1), this results in cracking or destruction of the foil conductor (1).

FIG. 3 depicts a longitudinal section through another embodiment of a housing (7, 7') according to the prior art. Compared to FIG. 2, the entry edges (9, 9') of the entry opening (8) are designed oblique and funnel-shaped. Here again, elevated tensile stresses appear in the regions in which the foil conductor (1) is guided over sharp edges.

FIG. 4 depicts a longitudinal section through a housing (7, 7') according to the invention with rounded entry edges (9, 9'). The entry edges (9, 9') are designed in the shape of semicircles both on the top of the housing (7) and on its bottom (7'). The diameter of the semicircle corresponds in this case to the height of one housing part. The angular segment of the rounded region has an angle of $\alpha=180°$. In the event of tensile loading of the foil conductor (1) orthogonal to its direction of extension, meaning upward or downward in FIG. 4, the foil conductor (1) runs along the rounding of the entry edge (9 or 9'). The forces occurring to deflect the foil conductor (1) act on the entire surface, on which the foil conductor (1) touches the entry edge (9 or 9'). The tensile stress in the foil conductor (1) is many times less than with the deflection over sharp edges with housings according to the prior art (FIG. 2, FIG. 3).

In a preferred embodiment of the housing (7, 7') according to the invention, the interior (10) is filled with plastic or covered with plastic, for example, polybutylene terephthalate. This protects the electrical connection against moisture and corrosion.

FIG. 5 depicts a longitudinal section through a housing (7, 7') according to the invention with quarter-circle-shaped rounded entry edges (9, 9'). In this embodiment, both the entry edge (9) of the top housing part (7) and the entry edge (9') of the bottom housing part (7') are rounded by a quarter circle. The angular segment of the rounded region of the entry edge (9, 9') has an angle of $\alpha$=90°.

FIG. 6 depicts an enlarged detail of the region of the entry opening (8) of FIG. 5. The curvature of the lower entry edge (9') occurs in the shape of a quarter circle with a radius r over an angle of $\alpha$=90°.

FIG. 7 depicts an enlarged detail of the entry opening (8) of a longitudinal section along the line I-I of FIG. 1 through a housing (7, 7') according to the invention. In contrast to FIG. 6, the curvature of the entry edges (9, 9') cannot be described by a single circular segment with constant radius. By way of example, two circles of curvature are depicted: the circle of curvature with radius $r_1$ describes the curvature at the point (14) of the rounded entry edge (9'). The point (14) is situated at the site of the biggest curvature and thus at the site with the smallest radius of curvature of the entire rounded region. A second circle of curvature is applied, by way of example, at the point (15) of the rounded entry edge (9') and has a radius of curvature of $r_2$.

FIG. 8 depicts a longitudinal section through a housing (7, 7') according to the invention with circular elements (12, 12') surface-mounted in the region of the entry edges (9, 9'). The elements (12, 12') are connected to the housing (7, 7') by adhesive bonding. A nonexhaustive list of possible elements (12, 12') that can be used includes circular packing cords or O-rings made of rubber, perfluorinated rubber, polyethylene, or polytetrafluoroethylene.

FIG. 9 depicts a longitudinal section through a housing (7, 7') according to the invention with circular elements (12, 12') inserted into the housing (7, 7'). In this case, the elements (12, 12') are fitted into a recess in the region of the entry edges (9, 9').

FIG. 10 depicts a longitudinal section through another embodiment of a housing (7) according to the invention. The housing (7) according to the invention is implemented as a half shell and connected to a substrate (16), for example, to a glass pane. The connection between the housing (7) and the substrate (16) can occur, for example, by adhesive bonding or clamping. The conductor (4) can be, for example, a round cable. Alternatively, the electrically conductive region (5) of the conductor (4) can be a metallic contact surface or a foil conductor, which is preferably connected to the substrate (16). The rounding according to the invention on the entry edge (9) of the foil conductor (1) into the housing (7) reduces the maximum tensile stress in the foil conductor (1) with a tensile load in the direction away from the substrate (16).

LIST OF REFERENCE CHARACTERS (1) foil conductor
(2) electrically conductive layer of (1)
(3, 3') electrically insulating foil of (1)
(4) conductor, round cable
(5) electrically conductive region of (4)
(6) insulating region of (4)
(7) housing, top part of housing
(7') housing, bottom part of housing
(8) entry opening for (1)
(9) entry edge of (7)
(9') entry edge of (7')
(10) interior of (7)
(11) electrically conductive connection, solder contact
(12) edge element, separate element for rounding the entry edge
(13) rounding of (7) in the long direction of (1)
(14) point of the entry edge (7') with radius $r_1$
(15) point of the entry edge (7') with radius $r_2$
(16) substrate, glass pane
(17) edge of (1)
(18) inner region of (1)
$\alpha$ angle of the angular segment of the rounding of the entry edge
r, $r_1$, $r_2$ radius of curvature, radius of the circle of curvature
I-I cutting plane

The invention claimed is:

1. A housing comprising:
a first housing part;
a second housing part;
an electrical connection between a conductor and a foil conductor; and
an entry opening for the foil conductor, the entry opening comprising at least one rounded entry edge, the rounded entry edge increasingly expanding the entry opening outwards,
wherein the entry opening is formed by the first housing part and the second housing part,
wherein the rounded entry edge is rounded in a plane perpendicular to the foil conductor, and
wherein the rounded entry edge is further rounded in a plane parallel to the foil conductor wherein rounding of the rounded entry edge is in a direction of extension of the foil conductor.

2. The housing of claim 1, wherein a rounded region of the rounded entry edge runs parallel to a wide side of the foil conductor.

3. The housing of claim 1, wherein the at least one rounded entry edge are two rounded entry edges.

4. The housing of claim 1, wherein a rounded region of the rounded entry edge is an angular segment with an angle of 30 degrees to 180 degrees.

5. The housing of claim 4, wherein the angular segment is with an angle of 80 degrees to 180 degrees.

6. The housing of claim 5, wherein the angular segment is with an angle of 135 degrees to 180 degrees.

7. The housing of claim 1, wherein a rounded region of the rounded entry edge has radii of curvature of at least 0.5 mm.

8. The housing of claim 7, wherein the radii of curvature are between 0.5 mm and 100 mm.

9. The housing of claim 8, wherein the radii of curvature are between 0.5 mm and 20 mm.

10. The housing of claim 1, further comprising an electrically insulating material.

11. The housing of claim 1, wherein the housing:
i) comprises a one-part or multi-part element,
ii) is formed directly around the electrical connection, or
iii) comprises a one-part or multi-part element, and is formed directly around the electrical connection.

12. The housing of claim 1, wherein the electrical connection is a solder, bond, weld, adhesive, or clamp connection.

13. The housing of claim 1, wherein the electrical connection connects at least one single-wire or multi-wire foil conductor with one or more of: another foil conductor, a single-wire or multi-wire cable, a wire, a metallic contact element, and a conductor path.

14. The housing of claim 1, wherein a rounded region of the rounded entry edge comprises a separate element, and is inserted into the housing, clamped into the housing, or adhesively bonded to the housing.

15. A method comprising:

using the housing of claim 1 in a motor vehicle or a construction.

16. The method of claim 15, further comprising:

contacting electrically functional layers through the housing.

17. The method of claim 16, wherein the electrically functional layers are heating conductors and/or antenna conductors on or in a single-pane safety glass pane or a multi-pane composite glass pane.

18. A composite pane comprising:

a foil conductor; and the housing of claim 1, for electrical connection of the foil conductor with a conductor.

* * * * *